United States Patent [19]

Gasbarra et al.

[11] Patent Number: 4,529,089

[45] Date of Patent: Jul. 16, 1985

[54] FOOD CONTAINER

[76] Inventors: Anthony Gasbarra, 19730 Crescent St., Lynwood, Ill. 60411; Edward Gasbarra, 6647 W. 111th St., Worth, Ill. 60482

[21] Appl. No.: 676,733

[22] Filed: Nov. 30, 1984

[51] Int. Cl.[3] ..... B65D 85/84

[52] U.S. Cl. ..... 206/525; 206/557; 426/109; 426/113; 219/10.55 E

[58] Field of Search ..... 426/113, 118, 109, 119; 219/10.55 E; 206/583, 525, 526, 557

[56] References Cited

U.S. PATENT DOCUMENTS

| | | | |
|---|---|---|---|
| 2,777,769 | 1/1957 | Hodges | 426/113 |
| 2,850,391 | 9/1958 | Gunsberg | 426/109 |
| 3,287,140 | 11/1966 | Brussell | 426/109 |
| 3,717,478 | 2/1973 | Lipfert | 426/109 |
| 3,871,357 | 3/1975 | Grosso et al. | 426/109 |
| 4,439,656 | 3/1984 | Peleg | 219/10.55 E |
| 4,481,392 | 11/1984 | Nibbe et al. | 219/10.55 F |

*Primary Examiner*—Joseph Man-Fu Moy

*Attorney, Agent, or Firm*—Hill, Van Santen, Steadman & Simpson

[57] ABSTRACT

A package is designed for storing and heating frozen food in individual serving portion. The package comprises a metal shell having an open chamber with a bottom wall. A shaped baffle is disposed in the chamber for separating the chamber into upper and lower compartments. The baffle has an extra compartment for holding a quantity of ice chips above the bottom wall and includes a plurality of aperatures for allowing the ice chips to descend into the lower compartment to produce steam for assisting in the heating of the food.

8 Claims, 3 Drawing Figures

FOOD CONTAINER

BACKGROUND

1. Field of the Invention

The present invention relates to a food container, and more particularly to such a container in which food may be heated preparatory to serving.

2. The Prior Art

A number of food containers have been developed for supporting and enclosing individual serving portions of food products, and some of these have been useful for storing and preparing a variety of products by heating in an oven or the like. However, it is desirable to provide a package in which it is possible to heat a product to serving temperature more rapidly, by using a stove top burner as a source of heat.

BRIEF DESCRIPTION OF THE INVENTION

It is a principal object to the present invention to provide a food package for storing and heating individual serving portions of food products in the most rapid and economical manner.

Another object of the present invention is to provide a package which allows a variety of food products to be simulataneously heated by different modes of heating, such as wet heat or dry heat.

Another object of the present invention is to provide a food package for storing and heating individual serving quantities of food products in which different products may be simultaneously baked, fried and steamed in the same container.

Another object of the present invention is to provide a food package for storing and heating individual serving portions of food products incorporating an ice containing chamber for helping to maintain the food product in frozen condition prior to heating, and for assisting the heating of certain ones of said food products by means of steaming during heating.

A further object of the present invention is to provide a food container having a specific shape, for facilitating the heating of different varieties of food products by means of different heating techniques.

In accordance with one embodiment of the present invention, a food container is provided having a metal shell, formed as two open chambers, with a shaped baffle disposed in one chamber for separating said chamber into upper and lower compartments. An exterior face of one of the chambers is offset relative to the plane of the exterior face of the other, so that the two chambers are adapted to be heated by conduction and radiant heat, respectively. The shaped baffle incorporates a plurality of enclosed regions containing ice chips of graduated dimensions, with a plurality of aperatures opening downwardly from said closed regions into the lower chamber of the compartment having the baffle. During heating, individual ones of said graduated ice chips fall into the lower chamber and are vaporized into steam, which steam is used for steaming as a part of the heating process.

The present invention achieves the advantage of permitting rapid heating of foods of different varieties in a single container, so that the preparation time for such food products is minimized.

These and other objects and advantages of the present invention will become manifest by an inspection of the following description and the accompanying drawings.

BRIEF DESCRIPTION OF THE DRAWINGS

Reference will now be made to the accompanying drawings in which.

DESCRIPTION OF THE PREFERRED EMBODIMENT

Figure 1:
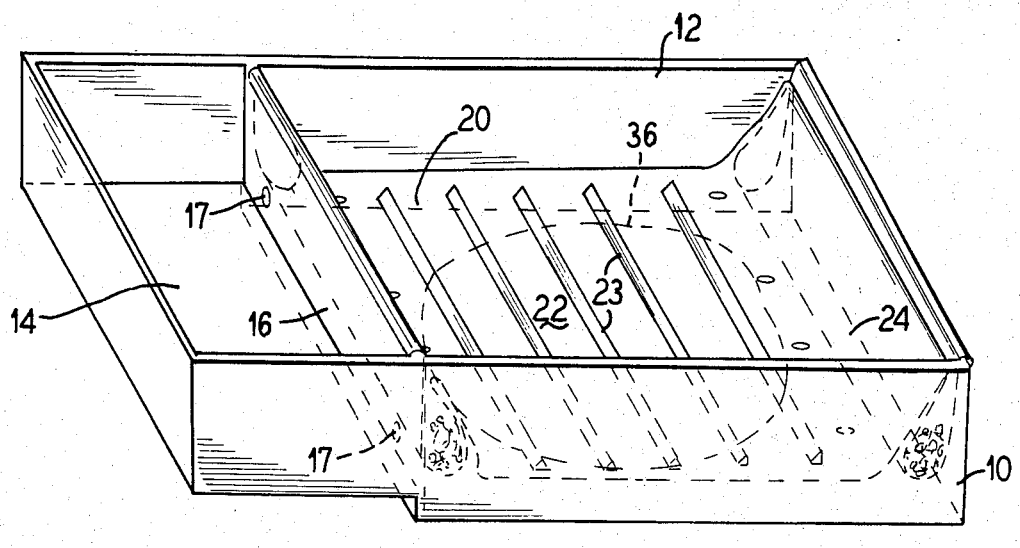
FIG. 1 is a perspective view of a food package incorporating an illustrative embodiment of the present invention.
Figure 2:
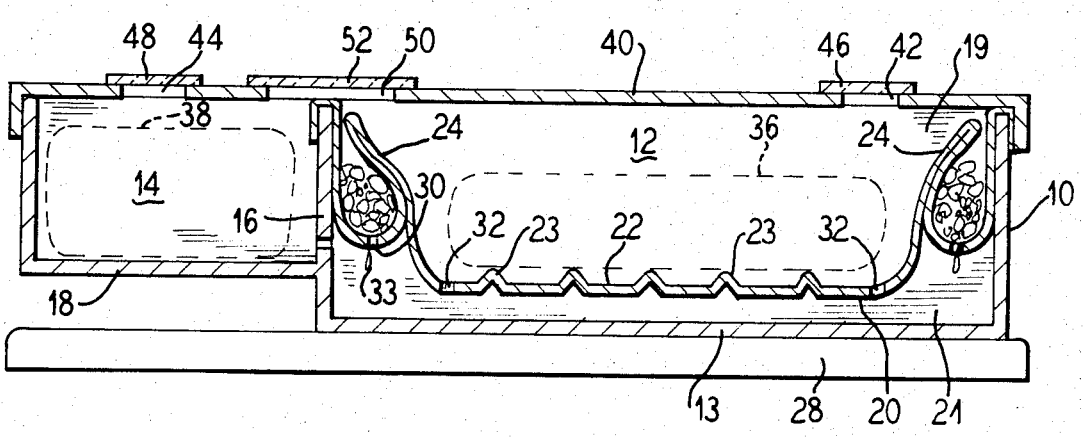
FIG. 2 is a vertical cross-sectional view of the container of FIG. 1, shown in place on a stove top.

Referring now to FIG. 1, a food package 10 is formed of aluminum sheet which has been stamped so as to form a shell-like self-supporting container having two separate chambers 12 and 14. The first chamber 12 is formed at one end of the container 10, with a second chamber 14 formed at the other end, the two chambers being separated by a vertical wall 16. The chamber 12 has its bottom wall 13 at the lower extremity of the container 10, while the bottom wall 18 of the chamber 14 is located in a plane which is vertically offset from the bottom wall of the chamber 12. This shape allows the container 10 to be placed on a stove top burner or the like, as shown in FIG. 2, so that the bottom wall 13 of the container 10 rests directly on the burner, whereas the bottom wall 18 of the compartment 14 is raised from the surface of the burner by short distance on the order of $\frac{3}{8}$ of an inch.

The chamber 12 is divided into upper and lower compartments 19 and 21, respectively, by means of a shaped baffle 20. The baffle 20 is formed of aluminum sheet material, and is shaped to have a central lower portion 22 adapted for supporting food to be cooked, and at least one pouch-like compartment 24 adapted to contain ice chips of graduated sizes. FIG. 2 illustrates the package in cross section, and illustrates two pouch-like compartments 24, having a series of apertures 30 opening into the lower compartment 21, spaced about 1 cm apart.

Figure 3:
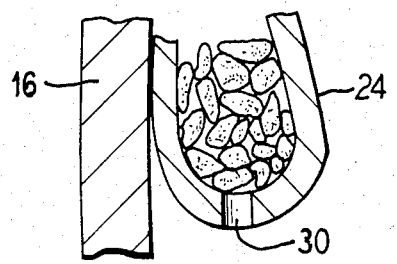
FIG. 3 is a portion of the apparatus of FIG. 2 shown in greater detail.

The pouch-like compartments 24 contain ice particles in graduated sizes. During cooking, the container rests on a stove top burner 28, and the ice melts within the compartments 24, as a result of the heat supplied by the burner, causing droplets of water 33 to fall onto the lower compartment 21 of the chamber 12. The water which reaches the bottom wall 13 is converted into steam by action of the heat received from the burner 28, and the steam 34 (FIG. 3) is forced upwardly through apertures 32 spaced about 1 cm apart in the panel 20. A serving of food 36 rests on the upper surface of the shaped baffle 20, and this food is heated from the bottom by heat passing through the bottom wall 13, and is also heated from the top by steam resulting from the vaporization of water in the lower compartment 21.

The other chamber 14 contains a serving quantity of food 38 which is intended to be prepared by application of dry heat such as by baking. The heat supplied to the interior of the compartment 14 is supplied by means of radiation from the burner 28, to the bottom wall 18, such radiation passing through the space separating the bottom wall 18 from the stove top or burner 28. A small number of apertures 17 are located in the wall 16 to admit a small quantity of steam to the chamber 14.

A cover 40 overlies the entire container. The cover 40 may be formed of any convenient material, such as aluminum or cardboard, and a pair of aperatures 42 and 44 are provided in the cover in alignment with the compartments 12 and 14. The apertures 42 and 44 are each covered by a removable strip 46 and 48, respectively, which is releasably adhesively secured to the top surface of the cover 40. The strips are selectively removable for controlling the temperature within the chambers 12 and 14 during heating. If the strips are left in place, a higher temperature is reached within a chamber, whereas a lower temperature can be selected by removing the strip.

A further aperture 50 is provided in the cover 40 at a location over the wall 16, and this aperture 50 is covered by a sheet 52 of transparent plastic material which is adhesively secured at its edges to the cover 40. The transparent sheet 52 provides a window by which a user may look into the compartments 12 and 14 and inspect the contents thereof, both at the time of purchase, and during the subsequent heating operation.

Preferably the bottom panel 22 of the shaped panel 20 within the chamber 12 is formed with a plurality of ridges 23, so that when the food product 36 is meat, such as a hamburger patty or the like, fat which is expelled from the meat during the heating process remains out of contact with the meat.

The shaped baffle 20 is held in palce by being crimped over the upper extremities of the middle wall 16 and an end wall of the container 10, as well as the joining side walls. It is held in that position during storage and heating by the cover 40. When the cover 40 is removed, however, the baffle 20 may be lifted out of its position in the container 10 and used as a serving tray or the like.

When the food package is employed for food products such as a hamburger with bun and french fries, the hamburger patty rests directly on the ridges 23 of the bottom surface 22 of the baffle 20, with the bun on top of the patty, and the french fries are contained in the chamber 14. During the heating operation, the hamburger patty is partly fried (by contact with the surface 22) and partly steamed, whereas the bun on top of the hamburger patty is steamed, and the french fries in the dry compartment 14 are baked. In each case, the temperature within the respective chambers may be controlled by selectively removing the strips 46 and 48, or permitting them to remain in place.

It is apparent that the present invention provides a food package which is suitable for containing and storing food products prior to heating, and which can be conveniently used to allow the food products to be heated on top of a stove. Since the stove top furnishes heat very rapidly to the container when it is in position on top of the burner, the food products within the container may be rapidly brought to a serving temperature.

Due to the relatively high temperature of the stove top, the present invention furnishes a means of preparing food products for consumption much more rapidly than with conventional packages which are required to be heated by placing them in hot air ovens.

Because of the water 33 dripping from the apertures 30 in the pouches 24, the temperature of the bottom panel 13 is maintained below the temperature at which it would be burned, so the bottom panel of the package is not consumed or otherwise destroyed during the heating process. Because of the effective cooling action of the water resulting from the ice particles, the bottom panel 34 may be formed of relatively thin sheet material of the same gage as the rest of the package. Therefore, no special manufacturing steps need be taken in connection with the formation of the bottom panel, despite the high temperature of the burner with which it is heated. The ice particles within the pouch-like compartments 24 are graduated in size in order to supply gradual introduction of the ice and water into the lower heating compartment. The finest sizes of ice chips may fall through the apertures 30 before they are melted, so that they are immediately available for cooling the bottom panel and for conversion into steam at the beginning of the cooking process. The larger particles of ice take longer to melt, and are therefore made available later on during the heating process. Because of the gradual introduction of water and ice into the lower portion of the chamber 12, the ice is rapidly vaporized into steam to promote the most efficient and fast introduction into steam into the upper portion of the chamber 12.

The vertical separation between the ice-containing compartments 24 and the bottom wall 13 causes the compartments 24 to be heated more slowly than the bottom wall 13. Aocordingly, the gradual introduction of melted ice into the bottom compartment of the chamber 12 allows for the generation of steam beginning almost immediately when the container 10 is placed on the burner 28, and extending over a period of time of about 5 minutes or less, depending on the heat of the burner 28. At the end of that time the food is ready to be eaten. The end of heating is signalled when steam no longer escapes from the aperature 42. If desired, the aperature 42 may be shaped to make a whistling noise in response to the escaping steam, to give an audible indication that the heating operation is finished.

The baffle 20 is formed of a rectagular sheet of material such as aluminum, and the pouches 24 are formed by crimping, after the ice has been put in place within the interior of the pouches. The pouches 24 maintain the ice in position without any need for completely sealing the pouches with adhesive or any fasteners. The side edges of the baffle do not need to fit snugly against the side walls of the package, because there is no need for a steam-tight seal. Ends of the baffle are hooked over vertical walls of the package 10.

In an illustrative embodiment of the present invention, the holes 30 are about 5–10 mm (3/16–$\frac{3}{8}$ inch) and the thickness of the aluminum sheet material used for all structural parts is about 0.09–0.17 mm (0.0035–0.0065 inch). The entire container may be about 20 cm long, 75–140 mm wide and 19–70 mm high ($8\times3$–$5\frac{1}{2}\times\frac{3}{4}$–$2\frac{3}{4}$ inches). The total quantity of ice used is between 6 and 50 grams, depending on the quantity and type of food product in the package.

By the foregoing, a preferred embodiment of the present invention has been described. It will be apparent that various additions and modifications may be made to the package of the present invention without departing from the essential features and novelty thereof, which are intended to be defined and secured by the appended claims.

What is claimed is:

1. In a package for storing and heating frozen food in individual serving portions, the combination comprising a metal shell having an open chamber with a bottom wall, a shaped baffle disposed in said chamber for separating said chamber into upper and lower compartments, said baffle being adapted to support a serving quantity of food product at a location spaced above said bottom wall, and said baffle having a compartment for holding a quantity of ice chips above said bottom wall, said compartment having a plurality of aperatures for allowing said ice chips to descend into said lower compartment and into contact with said bottom wall to produce steam for assisting in the heating of said food product.

2. The package of claim 1, wherein said ice chips are graduated in size.

3. The package of claim 1, including a second chamber in side-by-side relation with said first chamber, said second chamber bearing a second bottom wall spaced upwardly from the plane of the bottom wall of the first chamber, whereby a quantity of food product in said second chamber may be heated by radiant heat incident on said second bottom wall.

4. The package according to claim 1, including a plurality of aperatures in said baffle for allowing steam to escape from said lower compartment into said upper compartment.

5. The package according to claim 1, wherein said baffle is supported by being hooked over the upper extremities of a plurality of vertical walls of said shell.

6. The package according to claim 1, including a cover overlying said chamber and having a selectively openable vent for selectively controlling the heat in said chamber and for permitting the escape of steam from said upper compartment.

7. The food package according to claim 1, wherein said quantity of ice chips comprises a predetermined quantity proportional to the required heating time for said food product.

8. The food package according to claim 1, including a transparent window overlying said chamber for allowing visual observation of the contents thereof.

* * * * *